US009869086B2

(12) United States Patent
Andresen

(10) Patent No.: US 9,869,086 B2
(45) Date of Patent: Jan. 16, 2018

(54) THERMAL INSULATING AND SEALING MEANS FOR A SAFING SLOT IN A CURTAIN WALL

(71) Applicant: Hilti Aktiengesellschaft, Schaan (LI)

(72) Inventor: Arndt Andresen, Broken Arrow, OK (US)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 14/733,681

(22) Filed: Jun. 8, 2015

(65) Prior Publication Data

US 2016/0356034 A1 Dec. 8, 2016

(51) Int. Cl.

| | |
|---|---|
| ***E04H 1/00*** | (2006.01) |
| ***E04B 1/68*** | (2006.01) |
| ***E04B 2/90*** | (2006.01) |
| ***E04B 2/88*** | (2006.01) |
| *E04B 1/76* | (2006.01) |
| *E04B 2/96* | (2006.01) |
| *E04B 1/94* | (2006.01) |

(52) U.S. Cl.

CPC ..... *E04B 1/68* (2013.01); *E04B 2/88* (2013.01); *E04B 2/90* (2013.01); *E04B 1/94* (2013.01); *E04B 1/946* (2013.01); *E04B 1/947* (2013.01); *E04B 2/96* (2013.01); *E04B 2/962* (2013.01); *E04B 2/965* (2013.01); *E04B 2/967* (2013.01); *E04B 2001/7679* (2013.01)

(58) Field of Classification Search

CPC ..... E04B 1/68; E04B 2/90; E04B 2/88; E04B 2/962; E04B 2/96; E04B 1/947; E04B 1/946; E04B 2001/7679; E04B 2/965; E04B 2/967

USPC ..... 52/235, 489.1, 582.1, 234, 407.1, 407.5, 52/511, 506.4, 506.05

See application file for complete search history.

(56) References Cited

U.S. PATENT DOCUMENTS

| | | | | |
|---|---|---|---|---|
| 2,592,634 A * | 4/1952 | Wilson | E04B 1/04 | 52/125.5 |
| 3,604,167 A * | 9/1971 | Hays | E04B 1/24 | 52/282.4 |
| 4,346,543 A * | 8/1982 | Wilson | E04D 3/3602 | 52/404.2 |
| 4,449,341 A * | 5/1984 | Taglianetti | E04B 2/88 | 52/235 |
| 4,720,948 A * | 1/1988 | Henley | E04B 1/74 | 52/404.3 |
| 5,502,937 A * | 4/1996 | Wilson | E04B 1/948 | 52/273 |

(Continued)

*Primary Examiner* — Chi Q Nguyen

(74) *Attorney, Agent, or Firm* — Crowell & Moring LLP

(57) ABSTRACT

Described is a construction for effectively thermally insulating and sealing of a safing slot between a floor of a building and an exterior wall construction wherein the exterior wall construction comprises a curtain wall configuration utilizing an interior panel module design. The Thermal insulating and sealing means includes a supplemental insulation means positioned above the primary insulation means and attached to the interior panel of a curtain wall construction to maintain thermally insulating and sealing of the safing slot during exposure to fire and heat which can cause the interior panel to deform from heat distorting to an extent beyond the capability of standard safing insulation for expanding in order to maintain a proper seal extending across the safing slot.

20 Claims, 3 Drawing Sheets

(56) References Cited

U.S. PATENT DOCUMENTS

| | | | | |
|---|---|---|---|---|
| 5,765,332 | A * | 6/1998 | Landin | E04B 1/948 52/235 |
| 5,913,788 | A * | 6/1999 | Herren | E04B 2/825 52/236.7 |
| 7,424,793 | B1 * | 9/2008 | Shriver | E04B 2/88 52/235 |
| 7,856,775 | B2 | 12/2010 | Stahl, Jr. | |
| 8,671,645 | B1 * | 3/2014 | Shriver | E04B 2/88 156/71 |
| 8,782,977 | B2 * | 7/2014 | Burgess | E04B 2/00 52/235 |
| 2002/0148178 | A1 * | 10/2002 | Farag | E04B 2/96 52/204.1 |
| 2007/0204540 | A1 * | 9/2007 | Stahl, Sr. | E04B 5/00 52/274 |
| 2010/0107532 | A1 * | 5/2010 | Shriver | E04B 2/96 52/317 |
| 2012/0055102 | A1 * | 3/2012 | Fradera Pellicer | E04B 1/4121 52/167.1 |
| 2014/0157699 | A1 * | 6/2014 | Moeller | E04B 2/88 52/235 |
| 2017/0145685 | A1 * | 5/2017 | Andresen | E04B 1/947 |

* cited by examiner

THERMAL INSULATING AND SEALING MEANS FOR A SAFING SLOT IN A CURTAIN WALL

BACKGROUND AND SUMMARY OF THE INVENTION

The present invention relates to the field of constructions and systems designed to thermally insulate and seal a safing slot area defined between a curtain wall and the individual floors of a building. In particular, the present invention relates to a thermal insulating and sealing means for use with curtain wall structures which include an interior panel such as a back pan or other similar construction which can be of metal or other material extending across the interior surface of a curtain wall which is common in modular designs. The interior panels of a curtain wall are generally made from a metal or insulation material which can easily bend, distort or be otherwise deformed when exposed to strong winds or elevated temperatures, such as intensive sunlight or heat, such as in the event of a fire. Bending, distorting or deforming of these interior panels can result in significant problems in attempting to maintain a complete thermal insulation and seal within the safing slots between the outer edges of the floor construction and the exterior curtain wall construction during a storm or fire. In particular, maintaining of a complete thermal insulation and seal at all time during a fire is important to prevent heat, smoke and flames from spreading from one floor to an adjacent floor.

Curtain walls are general used and applied in modern building constructions and are the outer covering of said constructions in which the outer walls are non-structural, but merely keep the weather out and the occupants in. Curtain walls are usually made of a lightweight material, reducing construction costs. The wall transfers horizontal wind loads that are incident upon it to the main building structure through connections at floors or columns of the building. Curtain walls are designed to resist air and water infiltration, sway induced by wind and seismic forces acting on the building, and its own dead load weight forces. Curtain walls differ from store-front systems in that they are designed to span multiple floors, and take into consideration design requirements such as thermal expansion and contraction, building sway and movement, water diversion, and thermal efficiency for cost-effective heating, cooling, and lighting in the building.

A curtain wall structure is defined by an interior wall surface, which includes an interior panel, such as a back pan, extending over the interior surface thereof and at least one floor spatially disposed from the inner wall surface. The gap between the floor and the back pan of a curtain wall defines a safing slot, also referred to as perimeter slab edge, extending between the interior wall surface of the interior panel and the outer edge of the floor. This safing slot is essential to slow the passage of fire and combustion gases between floors. Therefore, it is of great importance to improve firestopping at the safing slot in order to keep heat, smoke and flames from spreading from one floor to an adjacent floor. It is important to note that the firestop at the perimeter slab edge is considered a continuation of the fire-resistance rating of the floor slab. The curtain wall itself, however, is not ordinarily required to have a rating.

Various designs have been known for curtain wall constructions and for means for thermally insulating and sealing the safing slot. For example, U.S. Pat. No. 7,856,775 B2 describes a thermal insulating and sealing means for a safing slot, wherein a supplementary insulation of thermally resistant material is attached to the interior panel of the wall at a position immediately below a primary insulation located between the interior panel and the floor, i.e. in the safing slot. Nevertheless, this employment has several drawbacks, such as that access is needed from the top and bottom to install said firestop system as well as the specific arrangement of the firestop system results in a limitation of joint width. Further, for example, perimeter fire-containment system CW-S-0002 from Specified Technology Inc. employs nom 4 pcf (64 kg/m3) density mineral wool batt insulation, which sections are cut to a width equal to the thickness of the floor and stacked to a thickness which is min. 50% greater than the width of the linear gap between the curtain wall insulation and the edge of the concrete floor slab, thereby being restricted in their application size. A min of 8 in. wide strips are needed in order to install the system properly resulting in a limitation of the system to the spandrel height, which is defined by the slab and strips thickness.

Therefore, there is a need for systems that can be easily installed within a safing slot, where, for example, access is only needed from one side, implementing a one-sided application. Further, there is a need for systems that are not limited to the width of a joint of a curtain wall structure. Additionally, maintaining safing insulation between the floors of a residential or commercial building and the exterior curtain wall responsive to various conditions including fire exposure should be guaranteed.

In view of the above, it is an object of the present invention to provide a thermal insulating and sealing means for thermally insulation and sealing of a safing slot in a building containing a curtain wall structure. In particular, it is an object of the present invention to provide a thermal insulating and sealing means which can be installed from one side, which maintains the safing insulation between the floors of a residential or commercial building and the exterior curtain wall responsive to various conditions, including fire exposure, and to maximize safing insulation at a minimal cost. Moreover, it is an object to provide a thermal insulating and sealing means which has no limitation of vertical movement capacities as well as limitation to spandrel height.

Further, it is an object of the present invention to provide a building construction comprising such a thermal insulating and sealing means for effectively thermally insulating and sealing of the safing slot between a curtain wall structure and the edge of a floor.

These and other objectives as they will become apparent from the ensuring description of the invention are solved by the present invention as described in the independent claims. The dependent claims pertain to preferred embodiments.

In one aspect, the present invention provides a thermal insulating and sealing means for effectively thermally insulating and sealing of a safing slot within a building construction having a wall construction defining an interior wall surface, which includes an interior panel extending over the interior surface thereof and at least one floor spatially disposed from the inner wall surface defining the safing slot extending between the interior wall surface of the interior panel and an outer edge of the floor, comprising a primary insulation means of thermally resistant material positioned in the safing slot, wherein the primary insulation means includes an inner primary end surface positionable in abutment with respect to the outer edge of the floor for sealing thereadjacent, an outer primary end surface positionable in abutment with respect to the interior panel, an upper primary facing surface extending between the inner primary end surface and the outer primary end surface and facing upwardly therebetween, a supplemental insulation means of thermally resistant material attached to the interior panel of a wall at a position immediately above the primary insulation means and in abutment with respect to the upper primary facing surface thereof, and a supplemental attachment means for attaching of the supplemental insulation means with respect to the interior panel positioned thereadjacent.

In another aspect, the present invention provides a building construction comprising said thermal insulating and sealing means.

BRIEF DESCRIPTION OF THE DRAWINGS

The subject matter of the present invention is further described in more detail by reference to the following figures.

DETAILED DESCRIPTION OF THE DRAWINGS

Figure 1:
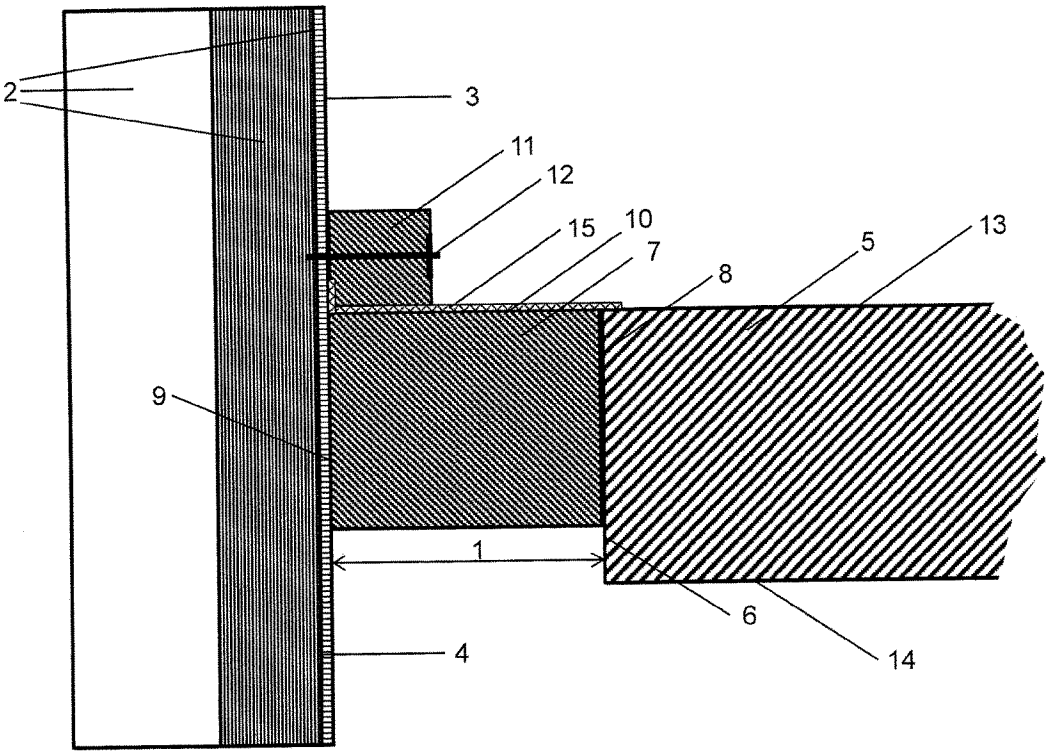
FIG. 1 shows a side cross-sectional view of an embodiment of the thermal insulating and sealing means between the outer edge of a floor and the interior wall surface of the interior panel when initially installed and attached to a steel back pan.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" in context with the present invention refers to a wall structure which is defined by an interior wall surface, including an interior panel, such as a back pan, extending over the interior surface thereof and at least one floor spatially disposed from the inner wall surface.

The term "safing slot" in context with the present invention refers to the gap between a floor and a back pan of a curtain wall; it is also referred to as "perimeter slab edge", extending between the interior wall surface of the interior panel, i.e. back pan, and the outer edge of the floor.

The term "internal panel" in context with the present invention refers, in particular, to a back pan, preferably a steel back pan.

The present invention pertains to a thermal insulating and sealing means for effectively thermally insulating and sealing of a safing slot within a building construction having a wall construction defining an interior wall surface, which includes an interior panel extending over the interior surface thereof and at least one floor spatially disposed from the inner wall surface defining the safing slot extending between the interior wall surface of the interior panel and an outer edge of the floor. In particular, the present invention pertains to a thermal insulating and sealing means for a curtain wall structure. The curtain wall back pan safing insulation means of the present invention is considered for the purpose of facilitating firestopping of a safing slot present in those buildings utilizing curtain wall structures for the exterior cladding thereof which includes interior panels, such as back pans, which are often made of materials that can deform responsive to exposure to heat.

A curtain wall structure is a type of exterior wall system commonly utilized on buildings wherein the curtain wall itself is a non-bearing wall. Such curtain walls generally are of a relatively lightweight material and commonly include brass or metal skins. This type of construction is normally used in high-rise buildings for providing a relatively lightweight and inexpensive overall construction.

Spandrel panels are included in the curtain wall structure to provide the exterior facing thereof and such panels are commonly made of glass, aluminum, thin sheets of foam material and the like. One particular type of unitized wall structure which is often used in modular constructions includes an interior panel comprising a metallic sheet extending across the internal membrane and this metal sheet is referred to as the back pan. Such curtain wall systems commonly include vertical framing members comprising boxed aluminum channels referred to as mullions and similarly configured horizontally extending pieces as referred to as transoms. Such a transom located or transom configuration at floor level is also known as zero spandrel, i.e., bottom of the transom at the level as top of the concrete floor. The interior panels of curtain wall structures can be made of many materials and many of these materials are susceptible to distorting responsive to high heat conditions. Some of these panels are of made from metallic materials but other non-metallic materials can also be used for this internal panel which are also capable of distorting such as insulation and aluminum clad insulation and many other materials. The thermal insulating and sealing means according to the present invention is applicable for all types of curtain wall structures.

The thermal insulating and sealing means for effectively thermally insulating and sealing of a safing slot within a building construction according to the present invention comprises:

i) a primary insulation means of thermally resistant material positioned in the safing slot, wherein the primary insulation means includes:

a) an inner primary end surface positionable in abutment with respect to the outer edge of the floor for sealing thereadjacent, b) an outer primary end surface positionable in abutment with respect to the interior panel, c) an upper primary facing surface extending between the inner primary end surface and the outer primary end surface and facing upwardly therebetween, ii) a supplemental insulation means of thermally resistant material attached to the interior panel of a wall at a position immediately above the primary insulation means and in abutment with respect to the upper primary facing surface thereof, and iii) a supplemental attachment means for attaching of the supplemental insulation means with respect to the interior panel positioned thereadjacent.

In particular, the primary insulation means according to the present invention includes an inner primary end surface positionable in abutment with respect to the outer edge of the floor for sealing thereadjacent. Furthermore, the primary insulation includes an outer primary end surface positionable in abutment with respect to the interior panel of the curtain wall structure and, preferably, attached to the interior surface of the interior curtain wall panel. Moreover, the primary insulation includes an upper primary facing surface extending between the inner primary end surface and the outer primary end surface thereof and facing upwardly therebetween.

It is preferred that the primary insulation means comprises a thermally resistant flexible material, preferably a mineral wool material, to facilitate placement thereof into the safing slot adjacent one another.

In a particular preferred embodiment of the present invention, the thermally resistant flexible mineral wool material is installed with fibers running parallel to the outer edge of the floor and the interior wall surface of the interior panel. Moreover, it is preferred that a min. 4 in. thick, 4-pcf density, mineral wool batt insulation is employed in the system of the present invention.

The outer primary end surface of the primary insulation means is preferably initially positioned in abutting contact with and unattached to the interior wall surface of the adjacent interior panel.

According to the present invention, the thermal insulating and sealing means further comprises a supplemental insulation means of thermally resistant material attached to the interior panel of a wall at a position immediately above the primary insulation means and in abutment with respect to the upper primary facing surface thereof.

It is preferred that the supplemental insulation means comprises a thermally resistant flexible material, preferably a mineral wool material, to facilitate placement thereof into the safing slot adjacent one another.

In a particular preferred embodiment of the present invention, the thermally resistant flexible mineral wool material is installed with fibers running parallel to the outer edge of the floor and the interior wall surface of the interior panel.

It is most preferred that the primary insulation means and the supplemental insulation means each comprise a thermally resistant flexible material, preferably a mineral wool material, to facilitate placement thereof into the safing slot adjacent one another.

The supplemental insulation means is in particular positioned in abutment with the upper primary facing surface of the primary insulation means and is attached to the interior wall surface of the interior panel and extends across the safing slot toward the outer edge of the floor thereadjacent.

In a particular preferred embodiment of the present invention, the supplemental insulation means is initially compressed against the upper primary facing surface of the primary insulation means when attached to the interior panel adjacent the upper primary facing surface to facilitate maintaining of abutment therewith responsive to thermal deforming movement of the interior panel.

According to the present invention, the thermal insulating and sealing means further comprises a supplemental attachment means for attaching of the supplemental insulation means with respect to the interior panel positioned thereadjacent.

It is preferred that the supplemental attachment means comprises at least one supplemental attachment device, such as at least one pin or screw means, and at least one nut or washer means. The at least one pin or screw means preferably extend through the supplemental insulation means and is attached to the interior wall surface of the interior panel; and wherein the at least one nut or washer means is secured to the at least one pin or screw means adjacent the supplemental insulation means at a position oppositely disposed from the interior wall surface of the interior panel. The pin means may comprise a weld pin means and the nut means may comprise a cap nut means. However, other attachment devices may be used to attach the supplemental means according to the present invention.

It is particular preferred that the supplemental insulation means is attached by the supplemental attachment means to the interior panel at a position immediately above the primary insulation means and in abutment with respect to the upper primary facing surface thereof and wherein the supplemental insulation means extends outwardly from the interior panel toward the outer edge of the floor. Further, the supplemental insulation means shall extend outwardly from the interior panel toward the outer edge of a floor to a position above the primary insulation means at a position spatially disposed from the outer edge of the floor thereadjacent. Moreover, the supplemental insulation means shall extend from the upper surface of adjacent floor to an intermediate position defined within the safing slot.

According to the present invention, the thermal insulating and sealing means may further comprise an outer fire retardant coating positioned across the primary insulation means and the adjacent portions of the interior wall surface of the interior panel and the floor located thereadjacent. The sealing characteristics of the construction shown in the present invention are significantly enhanced by the application of such fire retardant coating.

Generally, such outer fire retardant coatings are applied by spraying or other similar means of application. Such outer fire retardant coatings are for example firestop joint sprays, preferably based on water, and self-leveling silicon sealants. In one preferred embodiment of the present invention the outer fire retardant coating is a water-based firestop joint spray.

According to one embodiment of the present invention, it is preferred that the outer fire retardant coating has a wet film thickness of at least ⅛ in. Additionally, it is preferable that the outer fire retardant coating overs the top of the thermally resistant flexible mineral wool material overlapping the outer edge of the floor and the interior face of interior wall surface of the interior panel by a min of ½ in.

The outer fire retardant material can be applied across the primary insulation means and the adjacent areas of the interior panel and floor. Alternatively, or additionally, the outer fire retardant material can be applied across the supplemental insulation means and the adjacent areas of the interior panel.

Further, in a preferred embodiment of the present invention, the supplemental insulation means comprises a band of supplemental insulation extending continuous horizontal and in abutment with respect to the upper primary facing surface of the primary insulation means.

The band of supplemental insulation extending continuous horizontal and in abutment with respect to the upper primary facing surface of the primary insulation means, i.e., curtain wall cover strip, may be installed before or after the outer fire retardant material is applied, if the band of supplemental insulation is installed before the outer fire retardant material is applied, the band of supplemental insulation should be sprayed as well.

The band of supplemental insulation may be is fastened to the interior panel or directly to the transom by any fastening means known in the art. However, it is preferred that the band of supplemental insulation is fastened to the steel back pan, resulting in no limitation of vertical movement capacities of the joint system.

When installing, the primary insulation means is commonly compressed to varying degrees, but normally it is compressed to approximately 25%. This compression will cause the safing primary insulation means to exert a force outwardly against the curtain wall. The interior panels tend to deform responsive to heat by moving generally outwardly away from the safing slot. Because the primary insulation means is compressed into position, it has the capability to expand outwardly to fill these voids created in the primary insulation means responsive to deforming of the curtain wall. Thus if a curtain wall deforms outwardly by 25% of the lateral dimension of the primary insulation means, then the primary insulation means will be capable of filling that void if it was initially installed with 25% compression. In this manner the compression of the primary insulation means will be able to maintain the safing seal complete responsive to this limited amount of deforming of the interior panel. However, when the deforming of the interior panel is so extensive that it is greater than the horizontal distance into which the primary insulation means is capable of expanding, then a safing slot opening results, which is a dangerous and unwanted condition, but which is then sealed by installing the supplemental insulation means according to the present invention.

To further assure maintaining of abutment the supplemental insulation means can be initially installed some compression thereof against the upper surface of the primary insulation means. There is no specific means of attachment between the lower surface of the supplemental insulation means and the upper surface of the primary insulation means. These two surfaces can laterally slide along one another while maintaining abutting contact therebetween. This sliding relative movement would occur responsive to deforming of the interior panel since the supplemental insulation means is attached thereto. Further, there is no limitation of vertical movement capacities of the joint system, due to the attachment of the supplemental insulation means to the interior panel or to the transom, which in the latter case occurs on face. It should be appreciated that the lateral dimension of the supplemental insulation means can be varied significantly to accommodate various configurations of different interior panels and safing slots in order to accommodate and effective thermally insulate and seal any such safing slot, such as for example described below in FIG. 2 (transom configuration).

The thermal insulating and sealing means according to the present invention is preferably for use with a building construction having a wall construction defining an interior wall surface, which includes an interior panel extending over the interior surface thereof and at least one floor spatially disposed from the inner wall surface defining a safing slot extending between the interior wall surface of the interior panel and an outer edge of the floor.

In particular, the building construction comprises a thermal insulating and sealing means for effectively thermally insulating and sealing of the safing slot, wherein the thermal insulating and sealing means comprises:

i) a primary insulation means of thermally resistant material positioned in the safing slot defined between the outer edge of the floor and the interior panel to thermally insulate and seal the safing slot, wherein the primary insulation means includes:

a) an inner primary end surface positionable in abutment with respect to the outer edge of the floor for sealing thereadjacent, b) an outer primary end surface positionable in abutment with respect to the interior panel, c) an upper primary facing surface extending between the inner primary end surface and the outer primary end surface and facing upwardly therebetween, ii) a supplemental insulation means of thermally resistant material attached to the interior panel of a wall at a position immediately above the primary insulation means and in abutment with respect to the upper primary facing surface thereof, iii) a supplemental attachment means for attaching of the supplemental insulation means with respect to the interior panel positioned thereadjacent, iv) an outer fire retardant coating positioned across the primary insulation means and the adjacent portions of the interior wall surface of the interior panel and the floor located thereadjacent, wherein the supplemental attachment means comprises at least one pin or screw means extending through the supplemental insulation means and being attached to the interior wall surface of the interior panel, and at least one nut or washer means secured to the at least one pin or screw means adjacent the supplemental insulation means at a position oppositely disposed from the interior wall surface of the interior panel for facilitating attachment of the supplemental insulation means with respect to the interior wall surface of the interior panel immediately above the primary insulation means and in abutment with respect to the upper primary facing surface thereof, and wherein the supplemental insulation means of thermally resistant material is attached to the interior panel at a position immediately above the primary insulation means and in abutment with respect to the upper primary facing surface thereof and wherein the supplemental insulation means comprises a band of supplemental insulation extending continuous horizontal and in abutment with respect to the upper primary facing surface of the primary insulation means.

While the invention is particularly pointed out and distinctly described herein, a preferred embodiment is set forth in the following detailed description which may be best understood when read in connection with the accompanying drawings.

In FIG. 1 is shown a side cross-sectional view of an embodiment of the thermal insulating and sealing means for effectively thermally insulating and sealing of a safing slot 1 within a building construction having a wall construction 2 defining an interior wall surface 3, which includes an interior steel panel 4 extending over the interior surface thereof and at least one floor 5 spatially disposed from the inner wall surface 3 defining the safing slot 1 extending between the interior wall surface 3 of the interior panel 4 and an outer edge 6 of the concrete floor 5. The thermal insulating and sealing means comprises a primary insulation means 7 of thermally resistant material, such as thermally resistant flexible mineral wool material, positioned in the safing slot 1. The primary insulation means 7 includes an inner primary end surface 8 positioned in abutment with respect to the outer edge 6 of the floor 5 for sealing thereadjacent, an outer primary end surface 9 positioned in abutment with respect to the interior panel 4, an upper primary facing surface 10 extending between the inner primary end surface 8 and the outer primary end surface 9 and facing upwardly therebetween. The thermal insulating and sealing means comprises also a supplemental insulation means 11 of thermally resistant material, such as a thermally resistant flexible mineral wool material, attached to the interior panel 4 of a wall at a position immediately above the primary insulation means 7 and in abutment with respect to the upper primary facing surface 10 thereof, and a supplemental attachment means 12 for attaching of the supplemental insulation means 11 with respect to the interior panel 4 positioned thereadjacent. Not shown in FIG. 1 is that the thermally resistant flexible mineral wool material is installed with fibers running parallel to the outer edge 6 of the floor 5 and the interior wall surface 3 of the interior panel 4. It is important that insulation is provided between the edge 6 of the floor 5 and the curtain wall 2 in such a manner that the primary insulation means 7 extends from the floor 5 at a position between the upper floor surface 13 and the lower floor surface 14. The common placement of primary insulation means 7 is such that the inner primary end surface 8 abuts the outer edge 6 of the floor 5 and extending outwardly such that the outer primary end surface 9 is positioned in full abutting contact with respect to the interior panel 4 of the curtain wall structure 2. In FIG. 1, the band of supplemental insulation 15 extends continuous horizontal and in abutment with respect to the upper primary facing surface 10 of the primary insulation means 7. Not shown in FIG. 1 is that an outer fire retardant coating may be positioned across the primary insulation means 7 and the adjacent portions of the interior wall surface 3 of the interior panel 4 and the floor 5 located thereadjacent in order to further maintain a complete seal extending within the safing slot 1 in those conditions where the interior panel 4 has expanded beyond the lateral expansion capability of the primary insulation means 7. The supplemental insulation means 11 is attached to the interior panel 4 preferably by weld pins and cap nuts in such a manner as to be movable along any movement of the interior panel 4 such as when it deforms.

Figure 2:
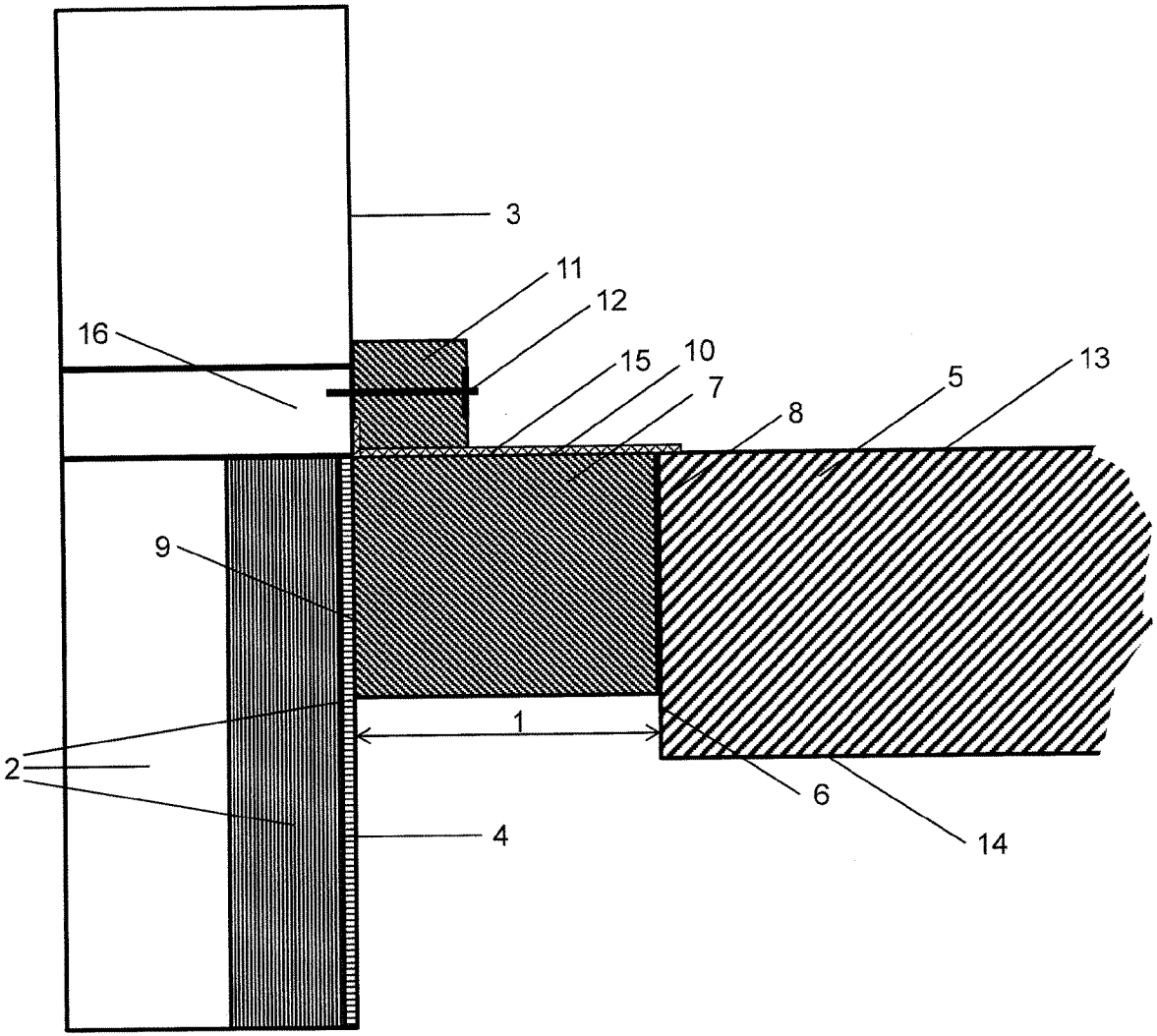
FIG. 2 shows a side cross-sectional view of an embodiment of the thermal insulating and sealing means between the outer edge of a floor and the interior wall surface of the interior panel when initially installed and attached to a transom.

In FIG. 2 is shown a side cross-sectional view of another embodiment of the thermal insulating and sealing means for effectively thermally insulating and sealing of a safing slot 1 within a building construction having a wall construction 2 defining an interior wall surface 3, which includes an interior steel panel 4 extending over the interior surface thereof and at least one floor 5 spatially disposed from the inner wall surface 3 defining the safing slot 1 extending between the interior wall surface 3 of the interior panel 4 and an outer edge 6 of the concrete floor 5. The thermal insulating and sealing means comprises a primary insulation means 7 of thermally resistant material, such as thermally resistant flexible mineral wool material, positioned in the safing slot 1. The primary insulation means 7 includes an inner primary end surface 8 positioned in abutment with respect to the outer edge 6 of the floor 5 for sealing thereadjacent, an outer primary end surface 9 positioned in abutment with respect to the interior panel 4, an upper primary facing surface 10 extending between the inner primary end surface 8 and the outer primary end surface 9 and facing upwardly therebetween. The thermal insulating and sealing means comprises also a supplemental insulation means 11 of thermally resistant material, such as a thermally resistant flexible mineral wool material, attached to the transom 16 of a wall at a position immediately above the primary insulation means 7 and in abutment with respect to the upper primary facing surface 10 thereof, and a supplemental attachment means 12 for attaching of the supplemental insulation means 11 with respect to the interior panel 4 positioned thereadjacent. Not shown in FIG. 1 is that the thermally resistant flexible mineral wool material is installed with fibers running parallel to the outer edge 6 of the floor 5 and the interior wall surface 3 of the interior panel 4. It is important that insulation is provided between the edge 6 of the floor 5 and the curtain wall 2 in such a manner that the insulation extends from the floor 5 at a position between the upper floor surface 13 and the lower floor surface 14. The common placement of insulation 7 is such that the inner primary end surface 8 abuts the outer edge 6 of the floor 5 and extending outwardly such that the outer primary end surface 9 is positioned in full abutting contact with respect to the interior panel 4 of the curtain wall structure 2. In FIG. 2, the band of supplemental insulation 15 extends continuous horizontal and in abutment with respect to the upper primary facing surface 10 of the primary insulation means 7. Not shown in FIG. 2 is that an outer fire retardant coating may be positioned across the primary insulation means 7 and the adjacent portions of the interior wall surface 3 of the interior panel 4 and the floor 5 located thereadjacent in order to further maintain a complete seal extending within the safing slot 1 in those conditions where the interior panel 4 has expanded beyond the lateral expansion capability of the primary insulation means 7. The supplemental insulation means 11 is attached to the transom 16 preferably by weld pins and cap nuts in such a manner as to be movable along any movement of the transom 16 such as when it deforms. Installation of the supplemental insulation means 11 is performed on face on the transom 16 and preferably the lateral height accommodates the height of the transom 16.

Figure 3:
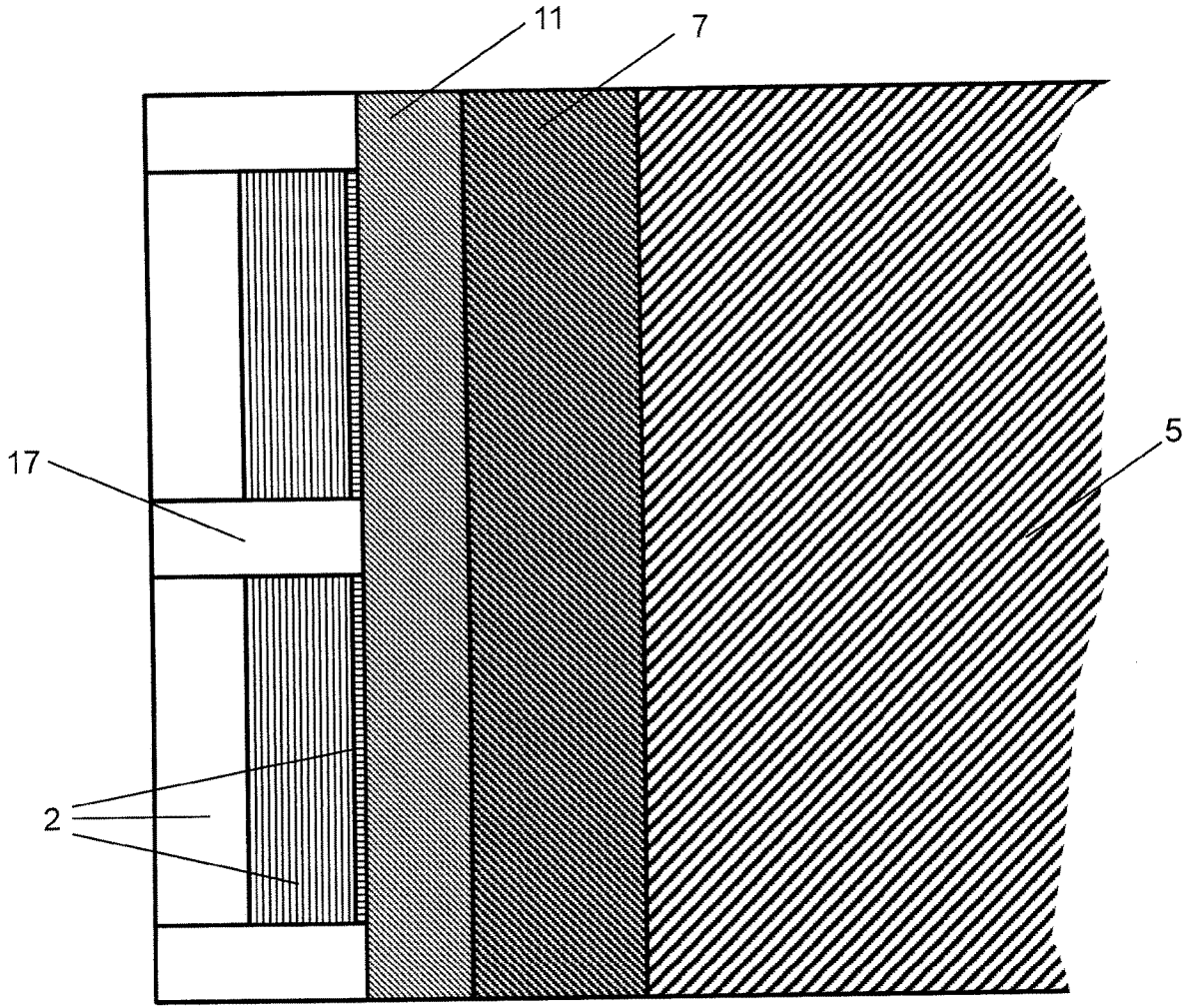
FIG. 3 is a top cross-sectional view of the embodiment shown in FIG. 1.

In FIG. 3 is a top cross-sectional view of the embodiment shown in FIG. 1. The vertical framing members comprising boxed aluminum channels are referred to as mullions 17.

It should be appreciate that these embodiments of the present invention will work with many different types of insulating materials used for the primary insulation means and/or the supplemental insulation means as long as the material has effective high temperature insulating characteristics.

It has been shown, that the thermal insulating and sealing means for sealing between the edge of a floor and an interior panel of the present invention maintains sealing of the safing slots surrounding the floor of each level in a building despite deforming of the interior panels especially those back pans made of various materials such as metal or the like which are positioned extending across the interior expanse of the curtain walls.

Moreover, the thermal insulating and sealing means for sealing between the edge of a floor and an interior panel of the present invention provide a means for supplementing the safing insulation surrounding the floors of a building by abutment with the uppersurface thereof by a supplemental belt of insulation which is attached to the interior surface of the interior panel of a modular curtain wall construction.

Furthermore, the thermal insulating and sealing means effectively create a continuous fireproofing seal extending from the outermost edge of the floor to the curtain wall structure and, in particular, to abutment with the interior panel extending across the curtain wall surface.

It has been shown that the thermal insulation and sealing means according to the present invention is easily installable from the top, i.e. a one-sided application. First, mineral wool is stuffed, followed by applying the outer fire resistant coating and installation of the horizontal insulation.

Further, the thermal insulating and sealing means is not limited to a specific joint width or spandrel height; on face installation on the transom is possible and there is no limitation of vertical movement capacities of the joint system, due to the fastening of the band of supplemental insulation to the interior panel.

As such, the thermal insulating and sealing means of the present invention provides a means for effectively maintaining a complete seal in a safing slot when utilizing modular curtain wall constructions which include interior panels extending across the interior surface thereof as is commonly utilized currently for modular or prefabricated designs.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A thermal insulating and sealing means for effectively thermally insulating and sealing of a safing slot within a building construction having a wall construction defining an interior wall surface, which includes an interior panel extending over the interior surface thereof and at least one floor spatially disposed from the interior wall surface defining the safing slot extending between the interior wall surface of the interior panel and an outer edge of the floor, wherein the interior panel is a metal back pan, comprising:

i) a primary insulation means of thermally resistant material positioned in the safing slot, wherein the primary insulation means includes:

a) an inner primary end surface positionable in abutment with respect to the outer edge of the floor for sealing thereadjacent, b) an outer primary end surface positionable in abutment with respect to the interior panel, and c) an upper primary facing surface extending between the inner primary end surface and the outer primary end surface and facing upwardly therebetween;

ii) a supplemental insulation means of thermally resistant material attached to the interior panel of a wall at a position immediately above the primary insulation means and in abutment with respect to the upper primary facing surface thereof; and iii) a supplemental attachment means for attaching of the supplemental insulation means with respect to the interior panel positioned thereadjacent.

2. The thermal insulating and sealing means according to claim 1, wherein the primary insulation means and the supplemental insulation means each comprise a thermally resistant flexible material to facilitate placement thereof into the safing slot adjacent one another.

3. The thermal insulating and sealing means according to claim 1, wherein the primary insulation means and the supplemental insulation means each comprise a thermally resistant flexible mineral wool material to facilitate placement thereof into the safing slot adjacent one another.

4. The thermal insulating and sealing means according to claim 3, wherein the thermally resistant flexible mineral wool material is installed with fibers running parallel to the outer edge of the floor and the interior wall surface of the interior panel.

5. The thermal insulating and sealing means according to claim 1, wherein the outer primary end surface of the primary insulation means is initially positioned in abutting contact with and unattached to the interior wall surface of the adjacent interior panel.

6. The thermal insulating and sealing means according to claim 1, wherein the supplemental insulation means is positioned in abutment with the upper primary facing surface of the primary insulation means and is attached to the interior wall surface of the interior panel and extends across the safing slot toward the outer edge of the floor thereadjacent.

7. The thermal insulating and sealing means according to claim 1, wherein the supplemental attachment means comprises:

at least one pin or screw means, and at least one nut or washer means.

8. The thermal insulating and sealing means according to claim 7, wherein the at least one pin or screw means extend through the supplemental insulation means and is attached to the interior wall surface of the interior panel; and wherein the at least one nut or washer means is secured to the at least one pin or screw means adjacent the supplemental insulation means at a position oppositely disposed from the interior wall surface of the interior panel.

9. The thermal insulating and sealing means according to claim 7, wherein the pin means comprises a weld pin means and wherein the nut means comprises a cap nut means.

10. The thermal insulating and sealing means according to claim 1, wherein the supplemental insulation means comprises a band of supplemental insulation extending continuous horizontal and in abutment with respect to the upper primary facing surface of the primary insulation means.

11. The thermal insulating and sealing means according to claim 1, wherein the supplemental insulation means is initially compressed against the upper primary facing surface of the primary insulation means when attached to the interior panel adjacent the upper primary facing surface to facilitate maintaining of abutment therewith responsive to thermal deforming movement of the interior panel.

12. The thermal insulating and sealing means according to claim 1, further comprising an outer fire retardant coating positioned across the primary insulation means and the adjacent portions of the interior wall surface of the interior panel and the floor located thereadjacent.

13. The thermal insulating and sealing means according to claim 12, wherein the outer fire retardant coating has a wet film thickness of at least ⅛ in.

14. The thermal insulating and sealing means according to claim 12, wherein the outer fire retardant coating covers the top of the thermally resistant flexible mineral wool material overlapping the outer edge of the floor and the interior face of interior wall surface of the interior panel by a min of ½ in.

15. The thermal insulating and sealing means according to claim 13, wherein the outer fire retardant coating is a water-based firestop joint spray.

16. The thermal insulating and sealing means according to claim 1, wherein the supplemental insulation means is attached to the interior panel at a position immediately above the primary insulation means and in abutment with respect to the upper primary facing surface thereof and wherein the supplemental insulation means extends outwardly from the interior panel toward the outer edge of the floor.

17. The thermal insulating and sealing means according to claim 16, wherein the supplemental insulation means extends outwardly from the interior panel toward the outer edge of a floor to a position above the primary insulation means at a position spatially disposed from the outer edge of the floor thereadjacent.

18. The thermal insulating and sealing means according to claim 1, wherein the supplemental insulation means extends from the upper surface of adjacent floor to an intermediate position defined within the safing slot.

19. A building construction having a wall construction defining an interior wall surface, which includes an interior panel extending over the interior surface thereof and at least one floor spatially disposed from the interior wall surface defining a safing slot extending between the interior wall surface of the interior panel and an outer edge of the floor, wherein the interior panel is a metal back pan, comprising a thermal insulating and sealing means for effectively thermally insulating and sealing of the safing slot, wherein the thermal insulating and sealing means comprises:

i) a primary insulation means of thermally resistant material positioned in the safing slot defined between the outer edge of the floor and the interior panel to thermally insulate and seal the safing slot, wherein the primary insulation means includes:

a) an inner primary end surface positionable in abutment with respect to the outer edge of the floor for sealing thereadjacent, b) an outer primary end surface positionable in abutment with respect to the interior panel, and c) an upper primary facing surface extending between the inner primary end surface and the outer primary end surface and facing upwardly therebetween;

ii) a supplemental insulation means of thermally resistant material attached to the interior panel of a wall at a position immediately above the primary insulation means and in abutment with respect to the upper primary facing surface thereof;

iii) a supplemental attachment means for attaching of the supplemental insulation means with respect to the interior panel positioned thereadjacent; and iv) an outer fire retardant coating positioned across the primary insulation means and the adjacent portions of the interior wall surface of the interior panel and the floor located thereadjacent, wherein the supplemental attachment means comprises at least one pin or screw means extending through the supplemental insulation means and being attached to the interior wall surface of the interior panel, and at least one nut or washer means secured to the at least one pin or screw means adjacent the supplemental insulation means at a position oppositely disposed from the interior wall surface of the interior panel for facilitating attachment of the supplemental insulation means with respect to the interior wall surface of the interior panel immediately above the primary insulation means and in abutment with respect to the upper primary facing surface thereof, and wherein the supplemental insulation means of thermally resistant material is attached to the interior panel at a position immediately above the primary insulation means and in abutment with respect to the upper primary facing surface thereof and wherein the supplemental insulation means comprises a band of supplemental insulation continuous horizontal along and in abutment with respect to the upper primary facing surface of the primary insulation means.

20. A thermal insulating and sealing system configured to thermally insulate and seal a safing slot within a building construction having a wall construction defining an interior wall surface, which includes an interior panel extending over the interior surface thereof and at least one floor spatially disposed from the interior wall surface defining the safing slot extending between the interior wall surface of the interior panel and an outer edge of the floor, wherein the interior panel is a metal back pan, the system comprising:

i) a primary insulation of thermally resistant material positioned in the safing slot, wherein the primary insulation includes:

a) an inner primary end surface positionable in abutment with respect to the outer edge of the floor for sealing thereadjacent, b) an outer primary end surface positionable in abutment with respect to the interior panel, and c) an upper primary facing surface extending between the inner primary end surface and the outer primary end surface and facing upwardly therebetween;

ii) a supplemental insulation of thermally resistant material attached to the interior panel of a wall at a position immediately above the primary insulation and in abutment with respect to the upper primary facing surface thereof; and iii) a supplemental attachment for attaching of the supplemental insulation with respect to the interior panel positioned thereadjacent.

* * * * *